United States Patent [19]

Ouellette

[11] 4,351,460

[45] Sep. 28, 1982

[54] TRANSPORT SYSTEM FOR PHOTO-TYPESETTING MACHINE

[75] Inventor: Alfred R. Ouellette, Saugus, Mass.

[73] Assignee: Itek Corporation, Lexington, Mass.

[21] Appl. No.: 159,428

[22] Filed: Jun. 16, 1980

[51] Int. Cl.[3] ..... B65H 23/18; B65H 17/18

[52] U.S. Cl. ..... 226/25; 226/38; 226/49; 226/195; 242/67.2; 242/67.4; 242/75.5

[58] Field of Search ..... 226/38, 39, 49, 50, 226/51, 195, 25, 24; 242/67.2, 67.3 R, 67.4, 75.2, 75.3, 75.5, 75

[56] References Cited

U.S. PATENT DOCUMENTS

| | | | |
|---|---|---|---|
| 1,881,056 | 10/1932 | McBain | 242/75.5 X |
| 2,658,693 | 11/1953 | Wolf | 242/75.5 |
| 3,233,843 | 2/1966 | Dockstader | 242/75.5 |
| 3,246,857 | 4/1966 | Morse | 242/67.4 X |
| 3,411,684 | 11/1968 | Tison et al. | 226/25 |
| 3,441,233 | 4/1969 | Defontenay | 242/75.5 |
| 3,809,336 | 5/1974 | Kollar et al. | 242/75.5 X |
| 3,904,145 | 9/1975 | Steinberger et al. | 226/195 X |

*Primary Examiner*—Stanley N. Gilreath
*Attorney, Agent, or Firm*—Homer O. Blair; Robert L. Nathans; Gerald H. Glanzman

[57] ABSTRACT

A flexible sheet transport system comprising a primary mechanism for feeding the flexible sheet at a predetermined velocity in either a forward or a reverse direction, a tension roller assembly disposed in the path of the flexible sheet so as to be frictionally engaged thereby, an auxiliary drive mechanism for applying tension to the flexible sheet, a coupling assembly connected between the tension roller assembly and the auxiliary drive mechanism and driven thereby in a given sense tending to rotate the tension roller in a direction to move the flexible sheet in the reverse direction. Included in the coupling assembly is a slip coupling that slips in response to application of a given torque and a unidirectional coupling that prevents movement of the coupling assembly in a sense opposite to the given sense.

11 Claims, 1 Drawing Figure

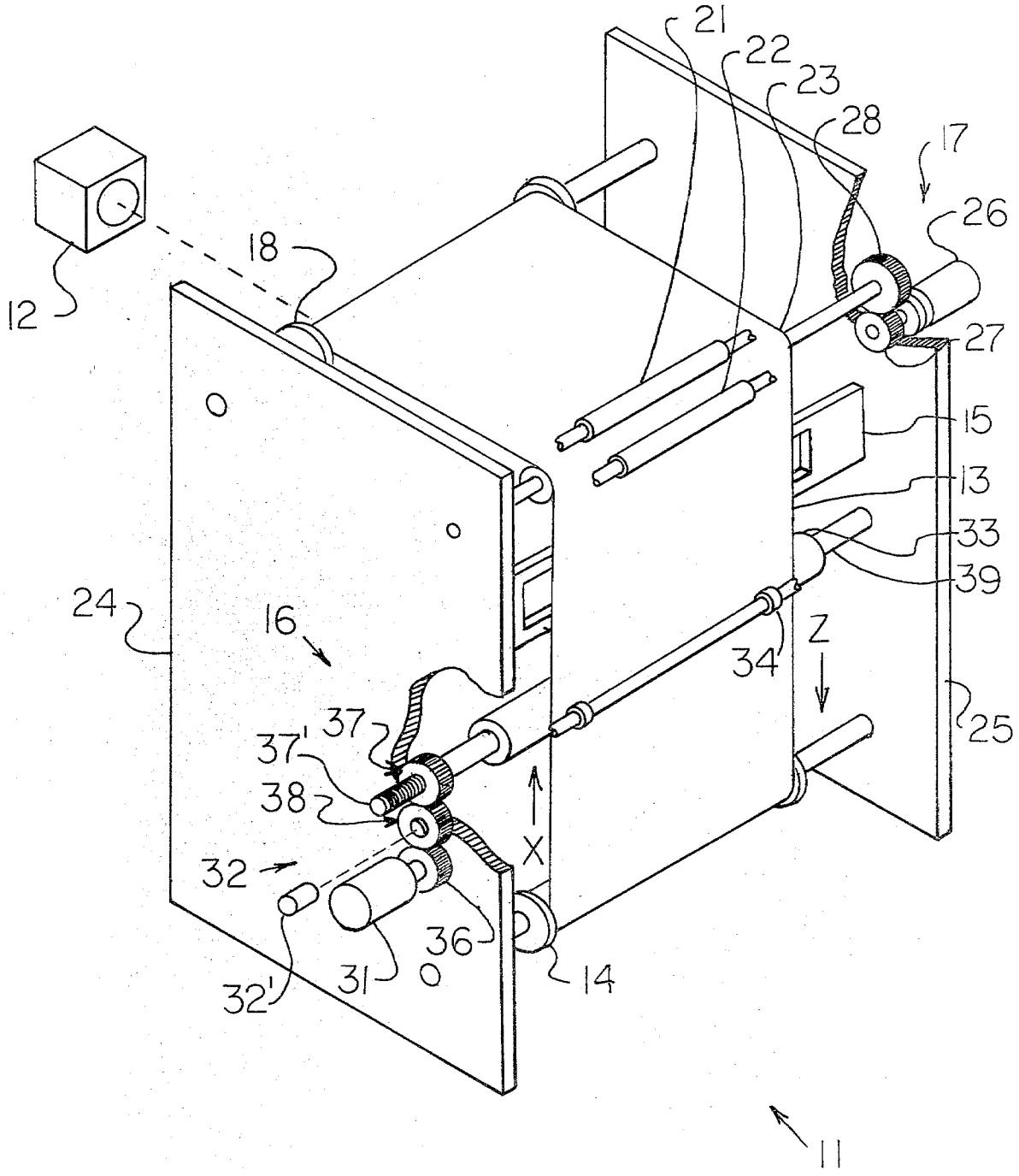
21
22
23
28
17
26
27
18
12
15
13
33
39
24
16
34
Z
25
37
37'
38
X
32
36
31
14
32'
11

TRANSPORT SYSTEM FOR PHOTO-TYPESETTING MACHINE

BACKGROUND OF THE INVENTION

This invention relates generally to a photo-typesetting machine and, more particularly, to a transport mechanism for delivering the photosensitive paper used in such machines.

Most printing machines employ some form of feed mechanism for either continuously or intermittently supplying a flexible sheet material that receives a print medium. The flexible sheet usually is maintained under tension so as to establish a predetermined alignment between successive lines of printed matter. Proper tensioning of the sheet material also is important in certain applications to insure stability of the sheet material during printing operations and thereby prevent blurring of the printed material. The latter factor is particularly significant for photo-typesetting machines in which images are optically produced on photosensitive sheet material.

A common passive type of tensioning system entails a pair of frictionally loaded tension rollers between which a flexible sheet is drawn by a suitable drive mechanism. Since the sheet material must be pulled through the tension rollers, the passive tensioning system has the deficiency of being effective only in those applications requiring a single direction of sheet material movement. For those applications requiring bi-directional sheet material movement, there have been employed and proposed semi-passive systems in which a tension roller is coupled to a one-way slip clutch and sympathetically driven by a main drive system. In a forward direction of sheet travel the tension roller is rotated by the frictional force of the moving sheet that overcomes the slip clutch. In the opposite direction of travel, the tension roller is driven by the main drive mechanism in the direction of sheet travel so as to maintain tension thereon. Although establishing tension for either direction of sheet material travel, the semi-passive tensioning system suffers the disadvantage of failing to provide dynamic tension in the absence of sheet material travel. This absence of tension at the completion of sheet travel after each phase of an intermittent feed system results in less than precise alignment of the sheet which can settle in a variety of positions within the backlash tolerance of the controlling elements.

Also known is an active tensioning system disclosed in U.S. Pat. No. 3,411,684. The active tensioning system utilizes an auxiliary motor that is connected to a tension roller by a slip coupling. During feed cycles, the frictional force generated by the moving sheet material overcomes the slip coupling to rotate the tension roller. Conversely, during static periods, the auxiliary motor drives the tension roller in a reverse direction to maintain tension on the stationary sheet. Although maintaining tension during both static and dynamic periods, the system disclosed in the previously noted U.S. patent exhibits the disadvantage of producing continuous rotation of the tension drive mechanism. In addition, the system fails to provide for bi-directional feed of the sheet material.

The object of this invention, therefore, is to provide an improved film transport mechanism for high speed photo-typesetting machines.

SUMMARY OF THE INVENTION

The invention is a flexible sheet transport system comprising a primary mechanism for feeding the flexible sheet at a predetermined velocity in either a forward or a reverse direction, a tension roller assembly disposed in the path of the flexible sheet so as to be frictionally engaged thereby, an auxiliary drive mechanism for applying tension to the flexible sheet, a coupling assembly connected between the tension roller assembly and the auxiliary drive mechanism and driven thereby in a given sense tending to rotate the tension roller in a direction to move the flexible sheet in the reverse direction. Included in the coupling assembly is a slip coupling that slips in response to application of a given torque and a unidirectional coupling that prevents movement of the coupling assembly in a sense opposite to the given sense. The coupling assembly employed in this combination induces continuous tension on a flexible sheet, both when stationary and when moving in either a forward or a reverse direction. In addition, the unidirectional coupling prevents continuous actuation of the coupling assembly during periods of forward movement.

According to one feature of the invention, the auxiliary drive mechanism includes a torque motor that produces a maximum torque less than the given torque required to overcome the slip coupling. This arrangement insures that continuous rotation of the auxiliary drive and coupling assembly does not occur during static periods.

According to another feature of the invention, the coupling is arranged to produce rotation of the tension roller assembly at a tangential velocity greater than the predetermined sheet material velocity produced by the primary drive mechanism. This arrangement insures the maintenance of desired tension during movement of the sheet material in the reverse direction.

A preferred embodiment of the invention includes as the flexible sheet material a supply of photosensitive paper, a platen positioned to sequentially support particular segments of the photosensitive paper in response to movement thereof produced by the primary drive mechanism and a projection system for projecting optical images on the particular segments of the photosensitive paper. The disclosed sheet material transport system is particularly well suited for feeding and positioning photosensitive paper in a high speed photo-typesetting machine.

DESCRIPTION OF THE DRAWING

These and other features and objects of the invention will become more apparent upon a perusal of the following description taken in conjunction with the accompanying drawing which is a schematic, perspective view of the invention.

DESCRIPTION OF THE PREFERRED EMBODIMENT

Illustrated in the drawing is a photo-typesetting machine 11 constructed in accordance with the present invention. The machine 11 includes a projection system 12 that selectively exposes optical images on a flexible sheet of photosensitive paper 13 fed from a supply reel 14. Selective bi-directional movement of the flexible paper sheet 13 over a stabilizing platen 15 is produced by a transport system 16. The projection system 12 is conventional and can comprise, for example, a cathode ray tube (not shown) and associated controls therefor. It will be appreciated that the entire machine 11 is retained within an optically tight housing (not shown) that prevents inadvertent exposure of the photosensitive paper 13.

The transport system 16 comprises a primary drive mechanism 17 that moves the photosensitive paper 13 between the supply roll 14 and a take-up reel 18. Included in the primary drive mechanism 17 are a pair of pinch rollers 21, 22 and a drive roller 23 that straddle the paper 13 and are rotatably supported between a pair of spaced apart walls 24, 25. Also included in the primary drive mechanism 17 is a bi-directional stepping motor 26 that is operatively coupled to the drive roller 23 by a pair of engaged gears 27, 28. The pinch rollers 21 and 22 are biased so as to maintain a continuous pressure between the drive roller 23 and the paper 13. Because of that pressure the paper 13 is driven in a forward direction X by counterclockwise rotation of the drive roller 23 (as viewed in the drawing) and in a reverse direction Z by clockwise rotation thereof. Thus, selective energization of the stepping motor 26 produces bi-directional, intermittent movement of the paper 13 between the supply reel 14 and the take-up reel 18. A conventional electrical control system (not shown) selectively energizes the stepping motor 26 to produce movement of the paper 13 that is synchronized with the optical images being projected by the projection system 12.

The tensioning assembly 16 includes a dc torque motor 31 that is operatively coupled by a gear coupling 32 to a tension roller 33 rotatably supported between the walls 24, 25. Biased so as to maintain a continuous pressure between the tension roller 33 and the paper 13 are a pair of pinch rollers 34. The gear coupling 32 includes a drive gear 36 fixed for rotation with the shaft of the torque motor 31, a driven gear 37 supported by a shaft 39 fixed to the tension roller 33 and an intermediate gear 38. Associated with the intermediate gear 38 is a conventional one-way clutch mechanism 32' that prevents rotation thereof in a clockwise direction (as viewed in the drawing). Similarly associated with the driven gear 37 is a conventional slip clutch 37' that responds to a given applied torque by permitting rotation of the tension roller independently of the clutch gear 37.

During operation of the machine 11, the bi-directional stepping motor 26 is selectively energized to produce intermittent movement of the paper 13 in either the forward direction X or the reverse direction Z. Conversely, the motor 31 is continuously energized producing a torque tending to produce rotation of the drive gear 36 in a clockwise direction (as viewed in the drawing), counterclockwise rotation of the intermediate gear 38 and clockwise rotation of the drive gear 37 and the tension roller 33. Thus, the tension system 16 produces a continuous force that tends to move the paper 13 in the reverse direction Z. However, during counterclockwise rotation of the drive roller 23, the more powerful forces generated by the drive mechanism 17 insure movement of the paper 13 in the forward direction X. The resultant frictional forces exerted between the paper 13 and the tension roller 33 cause counterclockwise rotation thereof and create through the driven gear 37 a torque tending to rotate the intermediate gear 38 in a clockwise direction. That torque instantaneously locks the intermediate gear 38 and thereby precludes rotation also of the torque motor 31, the drive gear 36 and the driven gear 37. Independent rotation of the tension roller 33 is permitted however by the slip clutch mechanism in the driven gear 37.

During clockwise rotation of the drive roller 23, the paper 13 is driven thereby in the reverse direction Z. Simultaneously, the continuously energized torque member 31 induces rotation of the coupling elements 36–38 at rotational speeds that tend to produce for the tension roller 33 a tangential velocity greater than the predetermined paper velocity produced by the primary drive mechanism 17. Consequently, the tension roller 33 exerts a continuous force that prevents any slack from developing in the paper 13 between the drive roller 23 and the tension roller 33.

Finally, in response to de-energization of the stepping motor 26, the drive roller 23 remains stationary to prevent movement of the paper 13. During these static periods, the energized auxiliary motor 31 exerts a continuous torque tending to rotate the tension roller 33 in the clockwise direction. The resultant force produced on the paper 13 is insufficient to overcome the holding frictional force provided by the stationary drive roller 23 and no paper movement occurs in the absence of slack between the drive roller 23 and the tension roller 33. However, any such slack is immediately eliminated by the continuously torqued tension roller 33. During static periods, the torque motor 31 and the coupling elements 36–38 also remain stationary because the maximum torque provided by the motor 31 is less than the torque required to produce slippage of the slip clutch associated with the driven gear 37 which therefore is retained by the stationary tension roller 33.

Thus, the present invention provides, in a photo-typesetting machine, a paper transport system that establishes continuous paper tension to prevent image misalignment or blurring. The continuous tension is applied for photosensitive paper movement in either forward or reverse directions as well as during static periods. Furthermore, the continuously applied tension is achieved without a requirement for rotation of the motor 31 and coupling elements 36–38 during either static periods or those involving forward paper travel.

Obviously, many modifications and variations of the present invention are possible in light of the above teachings. It is to be understood, therefore, that the invention can be practiced otherwise than as specifically described.

What is claimed is:

1. a flexible sheet transport and tensioning system comprising:

primary drive means for feeding the flexible sheet at a predetermined velocity in either a forward or a reverse direction; tension roller means disposed in the path of the flexible sheet so as to be frictionally engaged thereby;

auxiliary drive means; and, coupling means coupled between said tension roller means an said auxiliary drive means and driven thereby in a given sense that tends to produce rotation of said tension roller means in a direction to move the flexible sheet in said reverse direction, and wherein said coupling means comprises a slip coupling adapted to slip in response to application of a given torque of said tension roller in said forward direction and unidirectional coupling means for preventing movement of said auxiliary drive means in a sense opposite to said given sense.

2. A system according to claim 1 wherein said auxiliary drive means comprises a torque motor that produces a maximum torque less than said given torque.

3. A system according to claim 2 wherein said coupling means is adapted to produce rotation of said tension roller means at a tangential velocity greater than said predetermined velocity.

4. A system according to claim 3 wherein said slip coupling comprises a slip clutch and said unidirectional coupling comprises a unidirectional clutch.

5. A system according to claim 4 wherein said coupling means comprises a pair of engaged gears, one supporting said slip clutch and the other supporting said unidirectional clutch.

6. A system according to claim 5 wherein said primary drive means comprises a drive roller means and a reversible stepping motor operatively coupled thereto.

7. A system according to claim 2 including a supply of photosensitive sheet material adapted to be fed by said feed drive means, a platen positioned to sequentially support particular segments of said sheet material in response to movement thereof produced by said primary drive means, and means for projecting optical images on said particular segments of said sheet material.

8. A system according to claim 7 wherein said coupling means is adapted to produce rotation of said tension roller means at a tangential velocity greater than said predetermined velocity.

9. A system according to claim 8 wherein said slip coupling comprises a slip clutch and said unidirectional coupling comprises a unidirectional clutch.

10. A system according to claim 9 wherein said coupling means comprises a pair of engaged gears, one supporting said slip clutch and the other supporting said unidirectional clutch.

11. A system according to claim 10 wherein said primary drive means comprises a drive roller means and a reversible stepping motor operatively coupled thereto.

* * * * *